US010161603B1

(12) United States Patent
Liang

(10) Patent No.: US 10,161,603 B1
(45) Date of Patent: Dec. 25, 2018

(54) FULLY-SEALED LED DECORATIVE LAMP USED IN FESTIVALS

(71) Applicant: Dongguan Chen Cai Illuminating Technology Co., Ltd., Dongguan (CN)

(72) Inventor: Faquan Liang, Dongguan (CN)

(73) Assignee: Dongguan Chen Cai illuminating Technology Co., Ltd., Dongguan (CN)

( * ) Notice: Subject to any disclaimer, the term of this patent is extended or adjusted under 35 U.S.C. 154(b) by 0 days.

(21) Appl. No.: 15/642,052

(22) Filed: Jul. 5, 2017

(30) Foreign Application Priority Data

Jun. 21, 2017 (CN) ..... 2017 2 0725853

(51) Int. Cl.

| | |
|---|---|
| ***F21V 19/00*** | (2006.01) |
| ***F21V 23/00*** | (2015.01) |
| *F21Y 115/10* | (2016.01) |
| *F21W 121/00* | (2006.01) |

(52) U.S. Cl.
CPC ..... *F21V 19/003* (2013.01); *F21V 19/0025* (2013.01); *F21V 23/003* (2013.01); *F21W 2121/00* (2013.01); *F21Y 2115/10* (2016.08)

(58) Field of Classification Search
CPC ..... F21V 19/003; F21V 23/003
See application file for complete search history.

(56) References Cited

U.S. PATENT DOCUMENTS

| | | | | |
|---|---|---|---|---|
| 8,132,955 | B2 * | 3/2012 | Fan | F21V 31/00 362/267 |
| 8,690,386 | B2 * | 4/2014 | Lee | F21K 9/232 362/249.02 |
| 2017/0254523 | A1 * | 9/2017 | Tsai | F21V 23/002 |

* cited by examiner

*Primary Examiner* — Thomas M Sember
(74) *Attorney, Agent, or Firm* — Wang Law Firm, Inc.

(57) ABSTRACT

A fully-sealed LED decorative lamp used in festivals includes a bulb shell, a core column, a driving circuit board, an LED lamp body, and a lamp cap. The lamp cap and bulb shell are configured to form a sealed cavity. The core column is partially plugged and fixed into the bulb shell. This invention has the features of powerful function, simple structure, and reasonable design and uses a cup shaped groove filled with colloid and the structure of the LED lamp body to achieve the effect of sealing the light emitting circuit completely, so that the implementation of the present invention can prevent people from being exposed to electric shock after the bulb shell broken and the invention also can prevent short circuit or fire caused by the short circuit, so as to meet the safety regulation and requirement as set forth by the Article UL 588.

1 Claim, 3 Drawing Sheets

FULLY-SEALED LED DECORATIVE LAMP USED IN FESTIVALS

FIELD OF INVENTION

The present invention relates to a bulb type LED decorative lamp, in particular to a fully-sealed LED decorative lamp used in festivals and capable of ensuring that human bodies will not be exposed to electric shock even if a transparent bulb shell of the lamp is broken.

BACKGROUND OF INVENTION

1. Description of the Related Art

At present, LED decorative lamps become increasingly popular, and the conventional LED decorative lamp with the features of simple structure cannot satisfy the safety requirement for practical using environments. Specifically, a bulb type decorative lamp may be broken easily when the lamp falls down while the decorative lamp is being used in a relatively complicated environment, or the distance between the user and the lamp is very short, or the installation is improper. After the bulb type lamp is broken, the electrical part of the bulb type lamp (which is not fully-sealed) will be exposed, so that people are exposed to the risk of electric shocks. In practical using process, one may be electrically shocked or a fire may be caused by the short circuit of the positive and negative electrode circuits after the bulb lamp is broken. Obviously, there is a deficiency of the application and a concern of safety.

Based on the safety consideration, the UL certification establishes a new certification regulation (as set forth in Article 588), and the conventional LED decorative lamp no longer can satisfy the aforementioned regulation of the certification.

2. Summary of the Invention

Therefore, it is a primary objective of the present invention to overcome the drawbacks of the prior art by providing a fully-sealed LED decorative lamp used in festivals and capable of meeting the safety regulation of Article UL 588.

To achieve the aforementioned and other objectives, the present invention provides a fully-sealed LED decorative lamp used in festivals, comprising: a bulb shell, a core column, a driving circuit board, an LED lamp body, and a lamp cap, characterized in that the lamp cap and the bulb shell are configured to form a sealed cavity; the core column is partially plugged into the bulb shell and fixed to the bulb shell; the core column is plugged into an opening formed at an end of the bulb shell to form a cup-shaped groove, and the driving circuit board is received in the cup shaped groove; the core column is pre-buried with two flexible leads, and an end of the two flexible leads is coupled to the lamp cap for an electrical conduction, and the other end of the two flexible leads is extended form the bottom of the cup shaped groove to the outside and coupled to the driving circuit board; the LED lamp body includes a colloid, an LED luminous body buried in the colloid, and a flexible lead of the LED luminous body is extended from the colloid to the outside and coupled to the driving circuit board; and the cup shaped groove is filled with a colloid, and the colloid in the cup shaped groove is used for sealing the driving circuit board and the flexible leads of the LED lamp body.

The present invention has the features of powerful function, simple structure, and reasonable design and uses a cup shaped groove filled with colloid and the structure of the LED lamp body to achieve the effect of sealing the light emitting circuit completely, so that the implementation of the present invention can prevent people from being exposed to electric shock after the bulb shell broken and the invention also can prevent short circuit or fire caused by the short circuit, so as to meet the safety regulation and requirement as set forth by the Article UL 588.

DESCRIPTION OF THE PREFERRED EMBODIMENTS

The above and other objects, features and advantages of this disclosure will become apparent from the following detailed description taken with the accompanying drawings.

Figure 1:
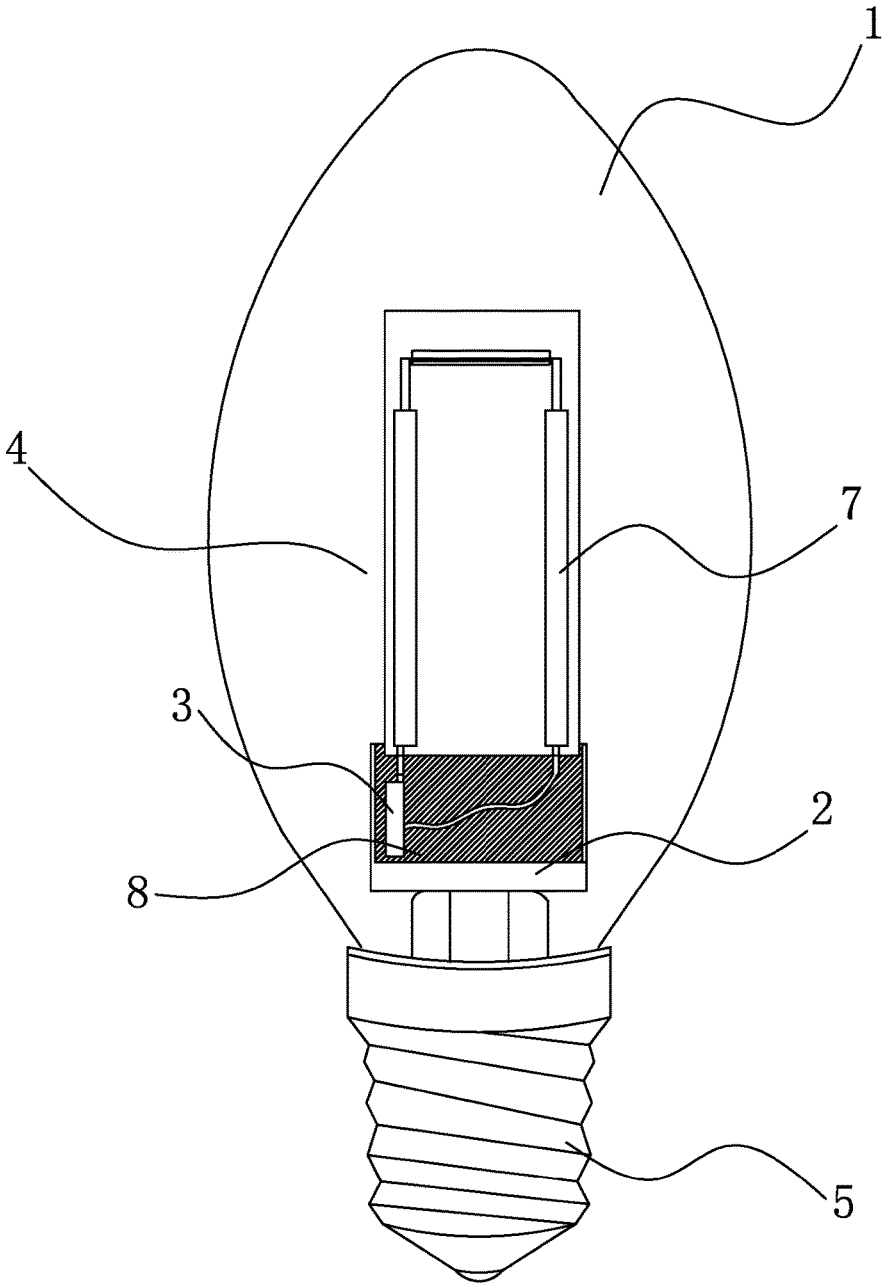
FIG. 1 is a schematic view of a fully-sealed LED decorative lamp used in festivals in accordance with the present invention.
Figure 2:
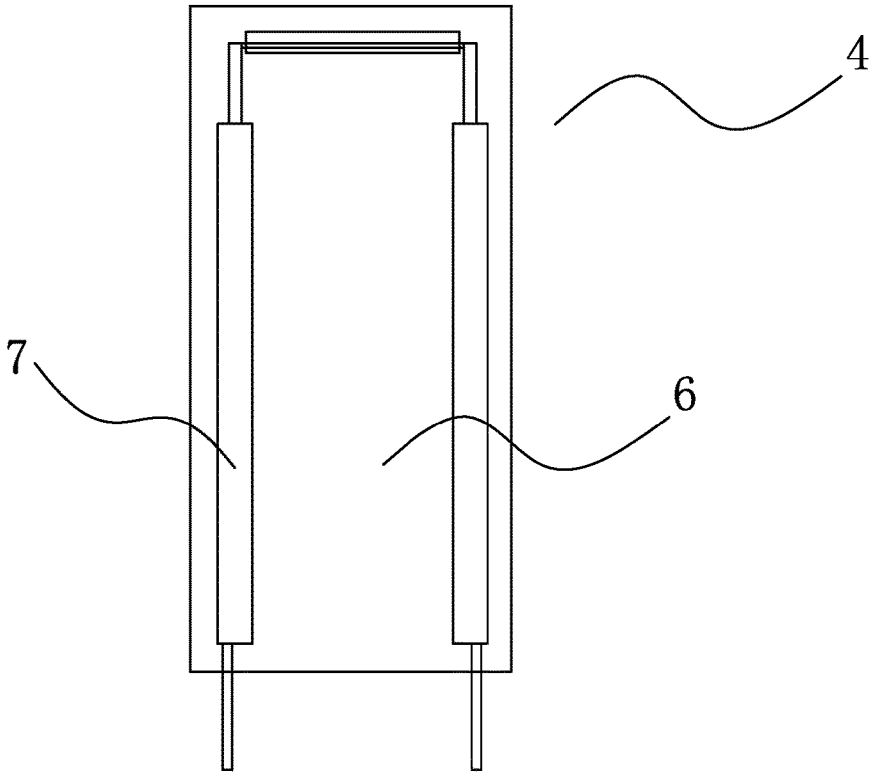
FIG. 2 is a schematic view of an LED lamp body in accordance with the present invention.
Figure 3:
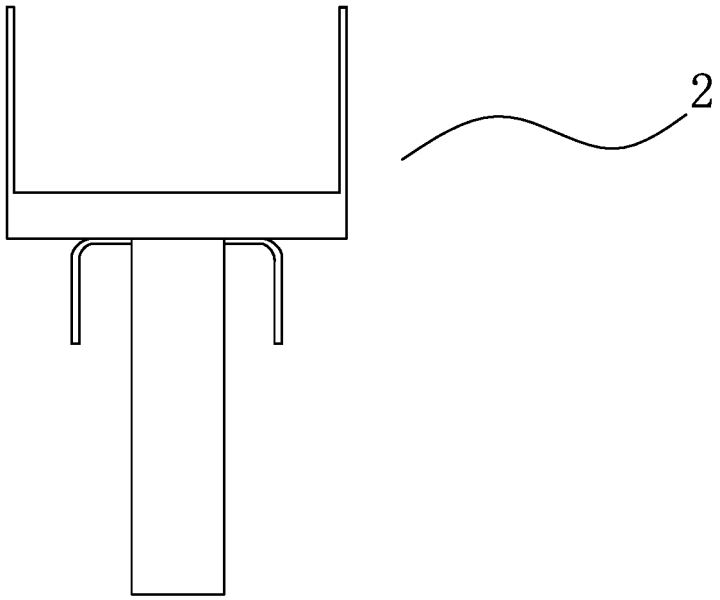
FIG. 3 is a schematic view of a core column in accordance with the present invention.

With reference to FIGS. 1 to 3 for a fully-sealed LED decorative lamp used in festivals in accordance with the present invention, the fully-sealed LED decorative lamp comprises a bulb shell 1, a core column 2, a driving circuit board 3, an LED lamp body 4, and a lamp cap 5, characterized in that the lamp cap 5 and the bulb shell 1 are configured to form a sealed cavity; the core column 2 is partially plugged into the bulb shell 1 and fixed to the bulb shell 1; the core column 2 is plugged into an opening formed at an end of the bulb shell 1 to form a cup-shaped groove, and the driving circuit board 3 is received in the cup shaped groove; the core column 2 is pre-buried with two flexible leads, and an end of the two flexible leads is coupled to the lamp cap 5 to achieve the effect of an electrical conduction, and the other end of the two flexible leads is extended from the bottom of the cup shaped groove to the outside and coupled to the driving circuit board 3; the LED lamp body 4 includes a colloid 6, an LED luminous body 7 buried in the colloid 6, wherein the flexible leads of the LED luminous body 7 are extended out from the colloid 6 and coupled to the driving circuit board 3; the cup shaped groove is filled with a colloid 8, and the colloid 8 in the cup shaped groove is used for sealing the driving circuit board 3 and the flexible leads of the LED lamp body 4.

While the invention has been described by means of specific embodiments, numerous modifications and variations could be made thereto by those skilled in the art without departing from the scope and spirit of the invention set forth in the claims.

What is claimed is:

1. A fully-sealed LED decorative lamp used in festivals, comprising:

a bulb shell, a core column, a driving circuit board, an LED lamp body, and a lamp cap, wherein the lamp cap and the bulb shell are configured to form a sealed cavity; the core column is partially plugged into the bulb shell and fixed to the bulb shell;

the core column is plugged into an opening formed at an end of the bulb shell to form a cup-shaped groove, the cup-shaped groove having a bottom, and the driving circuit board is received in the cup shaped groove;

the core column is pre-buried with two flexible leads, and an end of the two flexible leads is coupled to the lamp cap for an electrical conduction, and the other end of the two flexible leads is extended from the bottom of the cup shaped groove and coupled to the driving circuit board;

the LED lamp body includes a first colloid, an LED luminous body buried in the first colloid, and a flexible lead of the LED luminous body is extended from the first colloid and coupled to the driving circuit board; the cup shaped groove is filled with a second colloid, and the second colloid in the cup shaped groove is used for sealing the driving circuit board and the flexible leads of the LED lamp body.

* * * * *